US007361098B2

(12) United States Patent
Oyama

(10) Patent No.: US 7,361,098 B2
(45) Date of Patent: Apr. 22, 2008

(54) GOLF CLUB SHAFT

(75) Inventor: Hitoshi Oyama, Hyogo (JP)

(73) Assignee: SRI Sports Limited, Kobe-shi (JP)

( * ) Notice: Subject to any disclaimer, the term of this patent is extended or adjusted under 35 U.S.C. 154(b) by 0 days.

(21) Appl. No.: 11/212,869

(22) Filed: Aug. 29, 2005

(65) Prior Publication Data

US 2006/0073905 A1 Apr. 6, 2006

(30) Foreign Application Priority Data

Oct. 4, 2004 (JP) ..... 2004-291303

(51) Int. Cl.
*A63B 53/00* (2006.01)
*A63B 53/10* (2006.01)

(52) U.S. Cl. ..... 473/319

(58) Field of Classification Search ..... 473/316–323
See application file for complete search history.

(56) References Cited

U.S. PATENT DOCUMENTS 5,205,560 A * 4/1993 Hoshi et al. ..... 473/345
5,439,219 A * 8/1995 Vincent ..... 473/319
5,885,169 A * 3/1999 Ishizuka ..... 473/305
5,916,038 A * 6/1999 Uchiyama et al. ..... 473/290
6,322,458 B1 11/2001 Kusumoto et al.
6,602,150 B1 * 8/2003 Kosmatka ..... 473/342
2005/0209019 A1 * 9/2005 Schweigert ..... 473/329
2006/0052177 A1 * 3/2006 Nakahara et al. ..... 473/329
2006/0052180 A1 * 3/2006 Chang ..... 473/345

FOREIGN PATENT DOCUMENTS

JP 8-131587 * 5/1996
JP 9-38254 A 2/1997
JP 10-127838 A 5/1998
JP 2000-51413 * 2/2000
JP 2002-233597 * 8/2002
JP 2003-102883 * 4/2003

* cited by examiner

*Primary Examiner*—Stephen Blau
(74) *Attorney, Agent, or Firm*—Birch, Stewart, Kolasch & Birch, LLP

(57) ABSTRACT

A wood golf club (10) which is not less than 44 inches in a length thereof and whose head (14) is not less than 190 g in a weight thereof. The value of a ratio of a rigidity value EIt at a position spaced at an interval of 130 mm from a head-side front end of a shaft (11) of the golf club (10) to a rigidity value EIb at a position spaced at an interval of 250 mm from a grip-side rear end of the shaft (11) is set to not less than 0.50.

12 Claims, 4 Drawing Sheets

GOLF CLUB SHAFT

This nonprovisional application claims priority under 35 U.S.C. § 119(a) on Patent Application No(s). 2004-291303 filed in Japan on Oct. 4, 2004, the entire contents of which are hereby incorporated by reference.

FIELD OF THE INVENTION

The present invention relates to a golf club. More particularly, the present invention relates to a golf club in which a wood head can be designed to have its center of gravity at a low position thereof.

DESCRIPTION OF THE RELATED ART

To hit a golf ball (hereinafter often referred to as ball) a long distance with the golf club, in the conventional art, there is a tendency of designing the head having a high repulsive force. But the regulation on the repulsion of the head was issued, based on the amendment to the rule of the golf club made by the joint statement on the joint plan for "Effect of Spring" published by R & A (Royal and Ancient Golf Club of St. Andrews) and USGA (United States Golf Association) on May 9, 2002. Thereby the tendency of designing the head having a high repulsive force is shifting toward the tendency of designing the head having its center of gravity at a low position thereof.

That is, when the center of gravity of the head is set at a low position thereof, gear effect works. Thereby a ball is hit at a high drive angle with a golf club having such a head. Consequently the amount of backspin decreases, and hence there is an increase in the flight distance of the ball.

On the other hand, researches for making the head large are now being made to improve the directional stability of a hit ball in the left-to-right direction and the stability of the flight distance thereof by increasing the moment of inertia and enlarging a high repulsive area. But when the volume of the head is increased without changing the weight thereof, it is necessary to control the disposition of the center of gravity in a low degree of freedom by changing the thickness of the head. Thus in designing the head, it is difficult to dispose the center of gravity thereof at a low position. When the weight of the head is increased to enhance the degree of freedom in controlling the disposition of the center of gravity, i.e., when the head is heavy, the head does not return to an appropriate extent or returns to an excessive extent at an impact time. That is, the directional stability of the head is unfavorable. In addition, a user feels that the head is too heavy, thus having difficulty in swinging it.

There are proposed golf clubs for hitting the ball a long distance and improving the directional stability thereof.

For example, in the golf club disclosed in Japanese Patent Application Laid-Open No. 10-127838 (patent document 1), as shown in FIG. 5, it is described in the specification that the region B in which the flexural rigidity of the shaft increases at a rapid rate of change is provided forward from the portion A in which the flexural rigidity of the shaft is maximum and that thereby a user can have a very firm feeling when the user swings and improve the stability in handling the golf club and directional stability of a ball hit therewith.

In the golf club disclosed in Japanese Patent Application Laid-Open No. 9-38254 (patent document 2), it is described in the specification that the flight distance of a hit ball can be increased by specifically setting the ratio of the torsional rigidity (GI) to the flexural rigidity (EI) in a certain portion of the head-side front region of the shaft.

In the above-described golf clubs, attention is focused on only the distribution of the rigidity of the shaft, but consideration is not taken for the performance of the entire golf club to be displayed when the head and the shaft are combined with each other nor for enlarging the head nor for disposing the center of gravity of the head at a low position.

The present inventors measured the relationship between the weight of a wood golf club head commercially available and the ratio of a rigidity value EIt at the head-side front end of the shaft to a rigidity value EIb at the grip-side rear end thereof. According to the result of the measurement shown in FIG. 6, even in a golf club having a heavy head, the value of the ratio EIt/EIb is set to not less than 0.30 nor more than 0.48. This means that in the golf club commercially available, the relationship between the weight of the head and the rigidity value (the ratio EIt/EIb) of the shaft is not considered.

The shaft having a small ratio EIt/EIb is liable to flex at its front side. Thus when a heavy head is mounted on the shaft, the deformation amount of the shaft at its front side is so large that the orbit of the head is unstable during a swing, and thus the directional stability of the hit ball is unfavorable. Further the user feels that the head is heavy because the weight of the head is amplified by the flexing of the shaft, thus having difficulty in swinging the golf club because it is heavy.

Patent document 1: Japanese Patent Application Laid-Open No. 10-127838

Patent document 2: Japanese Patent Application Laid-Open No. 9-38254

SUMMARY OF THE INVENTION

The present invention has been made in view of the above-described problems. Therefore it is an object of the present invention to provide a golf club having a preferable operability and a directional stability of a golf ball (hereinafter often referred to as ball) hit therewith, even though the weight of a large head is set heavily to allow the head to be designed to have its center of gravity at a low position thereof.

To achieve the object, the present invention provides a golf club which is not less than 44 inches in its length and whose head is not less than 190 g in its weight. A value of a ratio of a rigidity value EIt at a position spaced at an interval of 130 mm from a head-side front end of a shaft of the golf club to a rigidity value EIb at a position spaced at an interval of 250 mm from a grip-side rear end of the shaft is set to not less than 0.50.

The reason the rigidity value at the position spaced at the interval of 130 mm from the head-side front end of the shaft is selected as the rigidity value EIt at the head side of the shaft is as follows: The shaft is inserted into a hozel of the head by about 30 mm from the head-side front end thereof and bonded thereto. Thus when the rigidity of the shaft is measured with the shaft supported at two supporting points spaced from each other by 200 mm (the bonded portion of the shaft is excluded), the center position between both supporting points is disposed at 130 mm from the head-side front end of the shaft. That is, the length of 130 mm from the head-side front end of the shaft is the dimension from the head-side front end of the shaft that is inserted into a hozel to the center position between both supporting points.

The reason the rigidity value of the shaft at the position spaced at the interval of 250 mm from the grip-side rear end thereof is selected as the rigidity value EIb of the shaft at the grip side thereof is as follows: The range of the shaft that is gripped by a golfer is about 150 mm. Thus when the rigidity of the shaft is measured with the shaft supported at two supporting points spaced from each other by 200 mm (the gripped portion of the shaft is excluded), the center position between both supporting points is spaced by 250 mm from the grip-side front end of the shaft.

When the golf club has the above-described construction and the head thereof is heavy, i.e., when the weight of the head is not less than 190 g, it is possible to secure the degree of freedom in designing the center of gravity of the head by appropriately setting the thickness of the head in various regions of the head. Thereby the center of gravity of the head can be disposed at a low position.

When the center of gravity of the head is disposed at a low position, it is possible to increase the drive angle of a ball hit with the golf club and the flight distance of the ball. Further when the large head having a weight not less than 190 g is combined with the shaft having the ratio EIt/EIb set to not less than 0.5, the deformation amount of the shaft at its front side is not too large when the golfer swings. Therefore the orbit of the large head is stable during the swing and hence the hit ball is favorable in the directional stability. In addition, the golfer does not have a feeling that the weight of the head is amplified by the flexing of the shaft, thus being able to swing and handle the golf club easily.

When the golf club has the above-described construction and the length not less than 44 inches, the head speed of the golf club is higher than that of a short golf club. Thereby the golfer can increase the flight distance of the ball.

As means for increasing the rigidity value EIt of the shaft at the head side thereof, the following means 1 through 4 can be adopted singly or in combination:

1) The outer diameter of the head-side front end portion is increased.
2) The modulus of elasticity of a prepreg for use in a head-side reinforcing layer is increased.
3) The content of a fiber of the prepreg for use in the head-side reinforcing layer is increased.
4) The thickness of the prepreg for use in the head-side reinforcing layer or the number of layers of the prepreg is increased.

As means for decreasing the rigidity value EIt of the shaft at the head side thereof, the following means 1 through 4 can be adopted singly or in combination:

1) The outer diameter of the head-side front end portion is decreased.
2) The modulus of elasticity of the prepreg for use in the head-side reinforcing layer is decreased.
3) The content of the fiber of the prepreg for use in the head-side reinforcing layer is decreased.
4) The thickness of the prepreg for use in the head-side reinforcing layer or the number of the layers of the prepreg is decreased.

As means for increasing the rigidity value EIb of the shaft at the grip side thereof, the following means 1 through 4can be adopted singly or in combination:

1) The outer diameter of the grip-side rear end portion is increased.
2) The modulus of elasticity of a prepreg for use in a grip-side reinforcing layer is increased.
3) The content of a fiber of the prepreg for use in the grip-side reinforcing layer is increased.
4) The thickness of the prepreg for use in the grip-side reinforcing layer or the number of layers of the prepreg is increased.

As means for decreasing the rigidity value EIb of the shaft at the grip side thereof, the following means 1 through 4 can be adopted singly or in combination:

1) The outer diameter of the grip-side rear end portion is decreased.
2) The modulus of elasticity of the prepreg for use in the grip-side reinforcing layer is decreased.
3) The content of the fiber of the prepreg for use in the grip-side reinforcing layer is decreased.
4) The thickness of the prepreg for use in the grip-side reinforcing layer or the number of layers of the prepreg is decreased.

The ratio EIt/EIb is increased or decreased by a method of increasing or decreasing the rigidity value EIt in combination with a method of increasing or decreasing the rigidity value EIb. In addition, the entire shaft is tapered at a high percentage from the small-diameter head-side front end thereof to the large-diameter grip end thereof to decrease the ratio EIt/EIb. Further the entire shaft is tapered at a low percentage from the small-diameter head-side front end thereof to the large-diameter grip end thereof to increase the ratio EIt/EIb.

It is favorable that the value of the ratio EIt/EIb is not more than 0.80. If the value of the ratio EIt/EIb is more than 0.80, the rigidity value of the shaft at its head-side front end is so high that the drive angle is small. Thereby the flight distance of the hit ball is not increased, and the golfer feels that the golf club is hard when the golfer hits the ball, thus having difficulty in handling it.

The value of the ratio EIt/EIb is favorably not more than 0.75, more favorably not more than 0.70, and most favorably not more than 0.65.

It is preferable that the rigidity value EIt is not less than $1.5\times10^6$ kgf·mm$^2$ nor more than $5.00\times10^6$ kgf·mm$^2$. If the rigidity value EIt is less than $1.50\times10^6$ kgf·mm$^2$, the rigidity of the shaft at the head-side front end thereof is so low that the orbit of the head is unstable during the swing, and hence the direction stability of the ball is unfavorable. On the other hand, if the rigidity value EIt is more than $5.00\times10^6$ kgf·mm$^2$, the rigidity of the shaft at the head-side front end thereof is so high that the golfer hits the ball at a small drive angle, cannot increase the flight distance of the ball, and feels that the golf club is hard when the golfer hits the ball, thus having difficulty in handling it.

Regarding the lower limit of the rigidity value EIt, the rigidity value EIt is set to favorably not less than $1.80\times10^6$ kgf·mm$^2$, more favorably not less than $2.00\times10^6$ kgf·mm$^2$, and most favorably not less than $2.50\times10^6$ kgf·mm$^2$.

Regarding the upper limit of the rigidity value EIt, the rigidity value EIt is set to more favorably not more than $4.50\times10^6$ kgf·mm$^2$, and most favorably not more than $4.00\times10^6$ kgf·mm$^2$.

It is favorable that the rigidity value EIb is not less than $2.00\times10^6$ kgf·mm$^2$ nor more than $10.00\times10^6$ kgf·mm$^2$. If the rigidity value EIb is less than $2.00\times10^6$ kgf·mm$^2$, the shaft is so soft at the grip side thereof that the golfer does not have a sense of security when the golfer swings. Further it is necessary for the golfer to control the orbit of the head in consideration of the deformation of the shaft at its grip side. Thus it is difficult for the golfer to control the orbit of the head. Thereby the directional stability of the ball hit with the golf club is unfavorable. On the other hand, if the rigidity value EIb is more than $10.00\times10^6$ kgf·mm$^2$, the grip side of the shaft is very hard, namely, inflexible. Thus it is difficult for the golfer to take a good timing in hitting the ball. In addition, if the rigidity value EIb is more than $10.00\times10^6$ kgf·mm$^2$, the entire shaft of the present invention becomes so hard that the shaft does not flex when the golfer swings. Thereby the golfer cannot increase the flight distance of the ball.

Regarding the lower limit of the rigidity value EIb, the rigidity value EIb is favorably not less than $2.50\times10^6$ kgf·mm$^2$ and more favorably not less than $3.00\times10^6$ kgf·mm$^2$. Regarding the upper limit of the rigidity value EIb, the rigidity value EIb is favorably not more than $9.00\times10^6$ kgf·mm$^2$ and more favorably not more than $8.00\times10^6$ kgf·mm$^2$.

When the weight of the head is too heavy, the golfer cannot swing the golf club to the full. Thus the directional stability of the hit ball is unfavorable, and the head speed is low. Thereby the flight distance of the hit ball is short. Therefore the weight of the head is favorably not more than 210 g, more favorably not more than 208 g, and most favorably not more than 205 g.

The volume of the head is set to favorably not more than 500 cc and more favorably not more than 470 cc. If the volume of the head is more than 500 cc, the volume of the head is so large that the golfer has a feeling of discomfort and has difficulty in assuming a proper posture in the swing. Further to allow the head to have a proper degree of strength, it is necessary to make the head heavy. Consequently the golfer has difficulty in swinging the golf club, thereby being incapable of increasing the flight distance of the ball hit with the golf club. Further the directional stability of the ball is unfavorable.

To allow the golfer to swing easily, the length of the golf club is set to favorably not more than 48 inches, more favorably not more than 47 inches, and most favorably not more than 46 inches.

The construction of the head to which the present invention is applicable is not specifically limited, but to a two-piece construction composed of a body and a face part; a three-piece construction composed of the body, the face part, and a crown part; and a four-piece construction composed of the body, the face part, the crown part, and a hozel part. These parts are formed by casting, forging, press forming or a combination thereof and integrated with each other by welding, bonding, brazing, diffusion joining.

The material for the head is not specifically limited, but it is possible to use metal materials such as a titanium alloy, an aluminum alloy, stainless steel, and a magnesium alloy; and resin reinforced with a fiber.

Regarding the shaft to which the present invention is applicable, a shaft made of resin reinforced with a reinforcing fiber is preferable because it is lightweight and allows designing to be accomplished at a high degree of freedom. The shaft of the present invention is formed by a sheet winding method, a filament winding method, and an internal pressure molding method.

Carbon fiber is preferable as the fiber for reinforcing resin. In addition, it is possible to use glass fiber, aramid fiber, boron fiber, aromatic polyamide fiber, aromatic polyester fiber, and ultra-high-molecular-weight polyethylene fiber as the fiber for reinforcing resin.

As resin to be reinforced with the reinforcing fiber, thermosetting resin and thermoplastic resin can be used. The thermosetting resin is preferable in terms of strength and rigidity. Epoxy resin is particularly preferable.

As the thermosetting resin, it is possible to use epoxy resin, unsaturated polyester resin, phenol resin, melamine resin, urea resin, diallyl phthalate resin, polyurethane resin, polyimide resin, and silicone resin.

As the thermoplastic resin, it is possible to use polyamide resin, saturated polyester resin, polycarbonate resin, ABS resin, polyvinyl chloride resin, polyacetal resin, polystyrene resin, polyethylene resin, polyvinyl acetate resin, AS resin, methacrylic resin, polypropylene resin, and fluororesin.

As described above, according to the present invention, since the weight of the head of the golf club is set to not less than 190 g, the head can be designed to have its center of gravity at a low position thereof. Therefore the ball can be hit at a high drive angle and thereby the flight distance thereof can be increased. Further even though a heavy large head is mounted on the shaft, the front side of the shaft does not deform too much. Therefore the ball hit with the golf club is favorable in the directional stability, and the golfer does not have a feeling that the weight of the head is amplified, thus being able to swing and handle the golf club easily.

DETAILED DESCRIPTION OF THE PREFERRED EMBODIMENTS

The embodiments of the present invention will be described below with reference to the drawings.

Figure 1:
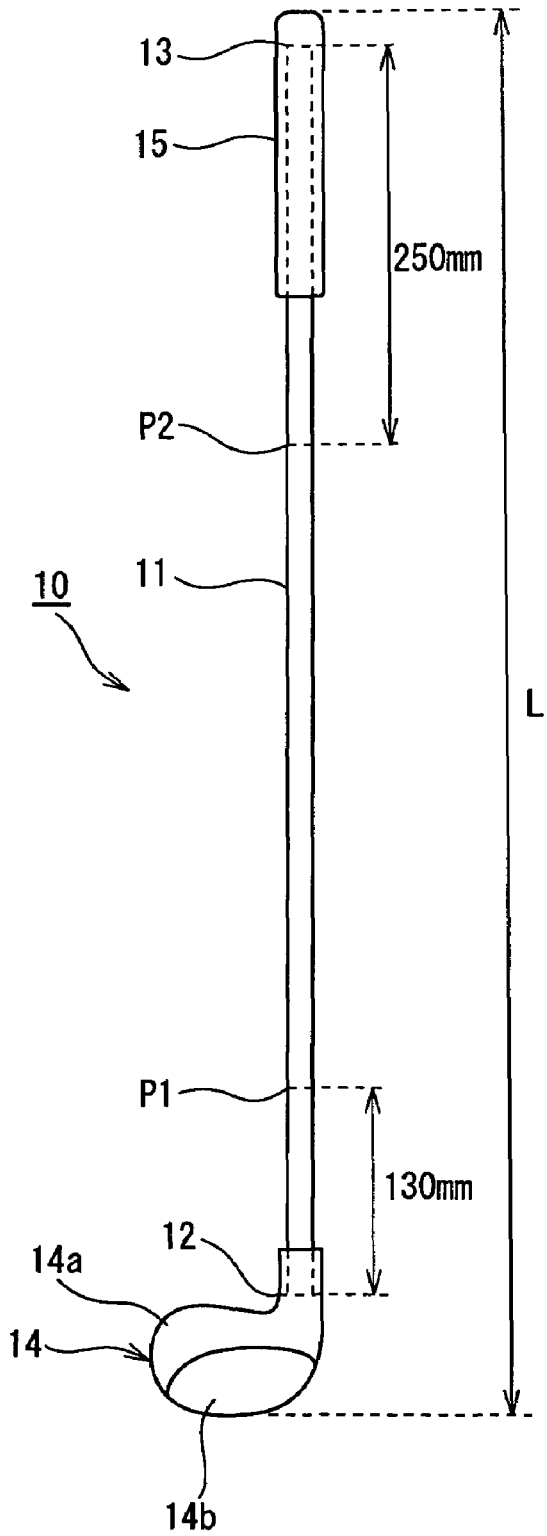
FIG. 1 is a schematic view showing a golf club according to a first embodiment of the present invention.
Figure 2:
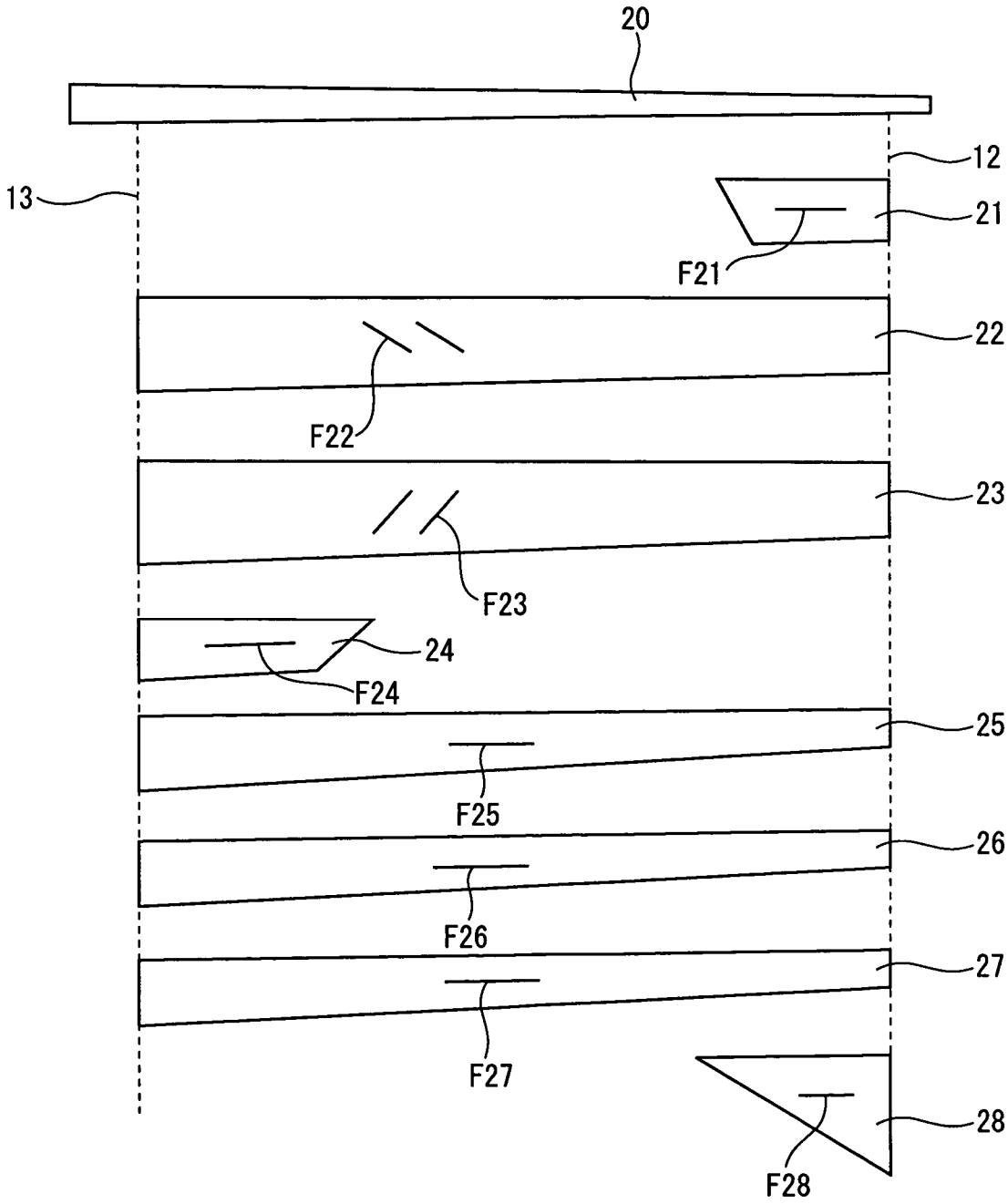
FIG. 2 shows a layered construction of fiber reinforced prepregs of the shaft of the golf club shown in FIG. 1.

FIGS. 1 and 2 show a golf club 10 according to a first embodiment of the present invention.

The golf club 10 has a tapered long hollow member composed of a laminate of prepreg sheets 21 through 28 reinforced with fibers, a wood head 14 mounted on a head-side front end 12 of the shaft 11, and a grip 15 mounted on a grip-side rear end 13. The length of the golf club 10 including the head 14 and the grip 15 both mounted on the shaft 11 is set to 45 inches. The length of the shaft 11 is set to 1135 mm.

The weight of the head 14 is set to not less than 190 g. The ratio of a rigidity value EIt of the shaft 11 at a position spaced at an interval of 130 mm from its head-side front end embedded in the head 14 to a rigidity value EIb thereof at a position spaced at an interval of 250 mm from the grip-side rear end thereof is set to not less than 0.50 nor more than 0.80. The rigidity value EIt is not less than $1.50\times10^6$ kgf·mm$^2$ nor more than $5.00\times10^6$ kgf·mm$^2$. The rigidity value EIb is not less than $2.00\times10^6$ kgf·mm$^2$ nor more than $10.00\times10^6$ kgf·mm$^2$. The length of the golf club 10 including the head 14 mounted on the shaft 11 is set to not less than 44 inches.

More specifically, the head 14 has a two-piece construction composed of a casting body 14*a* of 6-4Ti and a face member 14*b* formed by press-molding the rolled member of 6-4Ti and performing milling processing. The casting body 14*a* and the face member 14*b* are integrated with each other by plasma welding. The weight of the head 14 is set to not less than 190 g, namely, 198 g. The volume of the head 14 is set to 420 cc to allow the head 14 to have the center of gravity thereof at a low position thereof.

The shaft 11 is manufactured as follows, as shown in FIG. 2: Prepregs 21 through 28, impregnated with resin, which have reinforcing fibers arranged properly in one direction are sequentially wound round a mandrel 20 and layered one upon another by using a sheet winding method. A tape (not shown) made of polypropylene is wound round the laminate of the prepregs 21 through 28. Thereafter integral molding is performed by heating the laminate wound with the tape in an oven under pressure to harden the resin. Thereafter the mandrel 20 is drawn out of the laminate to manufacture the shaft 11. After the surface of the shaft 11 is polished, both ends thereof are cut. Then the shaft 11 is painted.

A prepreg produced by Toray Inc. is used for the fiber reinforced prepregs 21 through 28 composing the shaft 11. The fiber reinforced prepregs 21 through 28 each consisting of carbon fibers are impregnated with epoxy resin.

More specifically, the prepreg 21 has a length of 200 mm and a width to such an extent that the mandrel 20 is wound with three turns thereof at the head side of the shaft 11, thus constituting a reinforcing layer of the head-side front end region of the shaft 11. The reinforcing fiber F21 has an angle of 0° with respect to the axis of the shaft 11. The reinforcing fiber F21 consists of carbon fibers (kind of fiber: M30S) having a modulus of elasticity of 294 Gpa. The resin content of the prepreg 21 is set to 25%.

The length of the prepreg 22 is equal to the full length of the shaft 11. The prepreg 22 has a width to such an extent that the mandrel 20 is wound with five turns thereof at the head side of the shaft 11 and two turns thereof at the grip side thereof. The reinforcing fiber F22 has an angle of −45° with respect to the axis of the shaft 11. The reinforcing fiber F22 has a modulus of elasticity of 377 Gpa. The kind of the reinforcing fiber F22 is M40J. The resin content of the prepreg 21 is set to 25%.

The length of the prepreg 23 is equal to the full length of the shaft 11. The prepreg 23 has a width to such an extent that the mandrel 20 is wound with five turns thereof at the head side of the shaft 11 and two turns there at the grip side thereof. The reinforcing fiber F23 has an angle of +45° with respect to the axis of the shaft 11. The reinforcing fiber F23 has a modulus of elasticity of 377 Gpa. The kind of the reinforcing fiber F23 is M40J. The resin content of the prepreg 21 is set to 25%.

The prepreg 24 has a length of 350 mm and a width to such an extent that the mandrel 20 is wound with two turns thereof at the grip side of the shaft 11, thus constituting a reinforcing layer of the grip-side rear end region of the shaft 11. The reinforcing fiber F24 has an angle of 0° with respect to the axis of the shaft 11. The reinforcing fiber F24 has a modulus of elasticity of 230 Gpa. The kind of the reinforcing fiber F23 is T700S. The resin content of the prepreg 21 is set to 25%.

Each of the prepregs 25 through 27 is equal to the full length of the shaft 11. The prepreg 23 has a width to such an extent that the mandrel 20 is wound with one turn thereof. Each of the reinforcing fibers F25 through F27 has an angle of 0° with respect to the axis of the shaft 11. Each of the reinforcing fibers F25 through F27 has a modulus of elasticity of 294 Gpa. The kind of the reinforcing fiber F23 is M30S. The resin content of the prepreg 21 is set to 25%.

The prepreg 28 has a length of 250 mm and a width to such an extent that the mandrel 20 is wound with six turns thereof at the head side of the shaft 11, thus constituting a reinforcing layer of the head-side front end region of the shaft 11. The reinforcing fiber F28 has an angle of 0° with respect to the axis of the shaft 11. The reinforcing fiber F28 has a modulus of elasticity of 230 Gpa. The kind of the reinforcing fiber F23 is 700S. The resin content of the prepreg 21 is set to 25%.

In the shaft 11 composed of the laminate of the fiber reinforced prepregs 21 through 28, the rigidity value EIt at a point P1 spaced by 130 mm from the head-side front end 12 of the shaft 11 is set to 3.0 kgf·mm$^2$, and the rigidity value EIb at a point P2 spaced by 250 mm from the grip-side rear end 13 of the shaft 11 is set to 5.0 kgf·mm$^2$. Thus the value of EIt/EIb is set to 0.6.

Because the head 14 of the golf club 10 having the above-described construction is set to 190 g, the head 14 can be designed to have its center of gravity at a low position thereof. Therefore it is possible to increase the drive angle of a hit ball and the flight distance thereof. Since the value of the ratio EIt/EIb of the shaft 11 is not less than 0.50 nor more than 0.8, even when the above-described large head 14 is mounted on the shaft 11, the orbit of the head 14 is stable during a swing without the shaft 11 flexing too much at its front side. Therefore the directional stability of the hit ball is favorable. Further since the shaft 11 does not flex too much at its front side, the user does not have a feeling that the weight of the head 14 is amplified and that the weight of the head 14 is heavy. Thus the user can swing and handle it easily. Furthermore since the rigidity value EIt is not less than 1.50 nor more than 5.00, the shaft 11 does not flex too much nor is too hard at its front side and thus does not decrease the flight distance of the ball hit therewith. Further the user can obtain a preferable feeling when the user hits the ball.

EXAMPLES

To confirm the foregoing description, examples 1 through 8 of the golf club of the present invention and comparison examples 1 through 3 are described below in detail.

Figure 3:
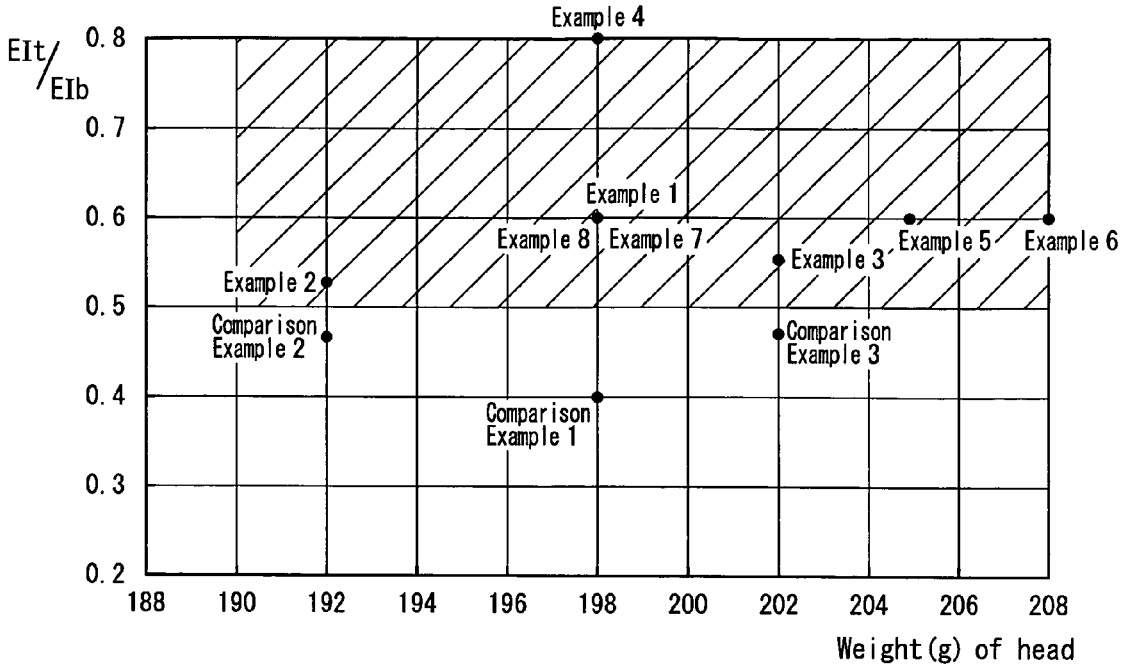
FIG. 3 is a distribution view showing setting of values of a ratio EIt/EIb with respect to weights of heads of golf clubs of examples of the present invention and comparison examples.

As shown in table 1, in the golf clubs 10 of the examples 1 through 8 and the comparison examples 1 through 3, the weights of the heads 14, the values of the ratio EIt/EIb of the shafts 11, and the values of the rigidity values EIt were set to different values to measure the directional stability of balls hit with the golf clubs, and the flight distance thereof and examine the degree of ease in the swing thereof by conducting a hitting test. Table 1 shows the results. FIG. 3 is a distribution view showing setting of values of a ratio EIt/EIb with respect to weights of heads of golf clubs of the examples 1 through 8 and the comparison examples 1 through 3.

TABLE 1

| | E1 | E2 | E3 | E4 | E5 | E6 |
|---|---|---|---|---|---|---|
| Weight (g) of head | 198 | 192 | 202 | 198 | 205 | 208 |
| EIt/EIb of shaft | 0.60 | 0.52 | 0.55 | 0.80 | 0.60 | 0.60 |
| EIt (kgf · mm$^2$) | $3.0 \times 10^6$ | $2.5 \times 10^6$ | $2.5 \times 10^6$ | $4.0 \times 10^6$ | $3.0 \times 10^6$ | $3.0 \times 10^6$ |

TABLE 1-continued

| | | | | | | |
|---|---|---|---|---|---|---|
| Evaluation (yard) of directionality (Deviated amount) | 32.2 | 36.7 | 39.1 | 30.6 | 38.6 | 41.4 |
| Flight distance (yard) | 227 | 215 | 223 | 216 | 230 | 226 |
| Evaluation on degree of ease in swinging golf clubs (on the bases of 5 points) | 4.4 | 3.7 | 3.1 | 3.8 | 4.1 | 3.3 |

| | E7 | E8 | CE1 | CE2 | CE3 |
|---|---|---|---|---|---|
| Weight (g) of head | 198 | 198 | 198 | 192 | 202 |
| EIt/EIb of shaft | 0.60 | 0.60 | 0.40 | 0.48 | 0.48 |
| EIt (kgf · mm$^2$) | $1.5 \times 10^6$ | $5.0 \times 10^6$ | $2.5 \times 10^6$ | $2.5 \times 10^6$ | $2.5 \times 10^6$ |
| Evaluation (yard) of directionality (Deviated amount) | 40.2 | 28.5 | 54.3 | 47.6 | 56.9 |
| Flight distance (yard) | 219 | 212 | 217 | 213 | 221 |
| Evaluation on degree of ease in swinging golf clubs (on the bases of 5 points) | 3.5 | 3.9 | 2.0 | 2.8 | 2.3 |

where E denotes example where CE denotes comparison example.

In the shaft 11 of the examples 1 through 8 and the comparison examples 1 through 3, the rigidity value EIt of the shaft 11 and the ratio EIt/EIb were increased or decreased by altering the content of the resin of the fiber reinforced prepregs 21, 24, and 28 and the modulus of elasticity of the reinforcing fibers F21, F24, and F28. In the shaft 11 of the examples 1 through 8 and the comparison examples 1 through 3, the layered construction of the fiber reinforced prepregs 21 through 28, the method of manufacturing the shaft 11, the construction of the head 14, and the material of the head 14 were the same as those of the first embodiment.

Method of Measuring Rigidity Value

Figure 4:
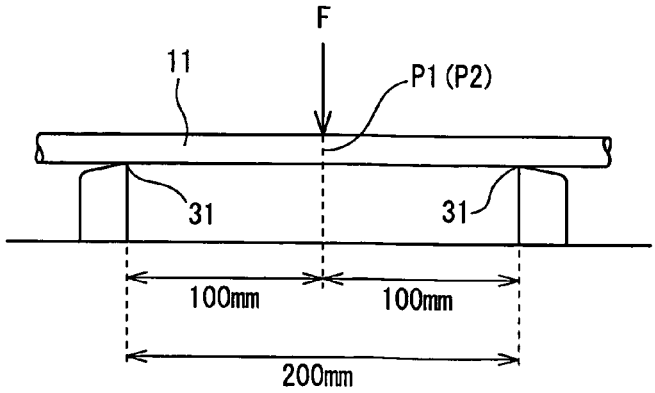
FIG. 4 shows a method of measuring a rigidity value.
Figure 5:
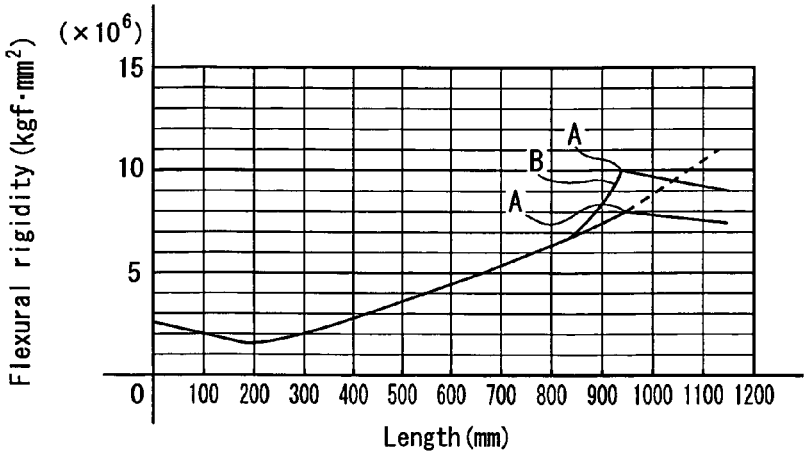
FIG. 5 is a graph showing a conventional art.
Figure 6:
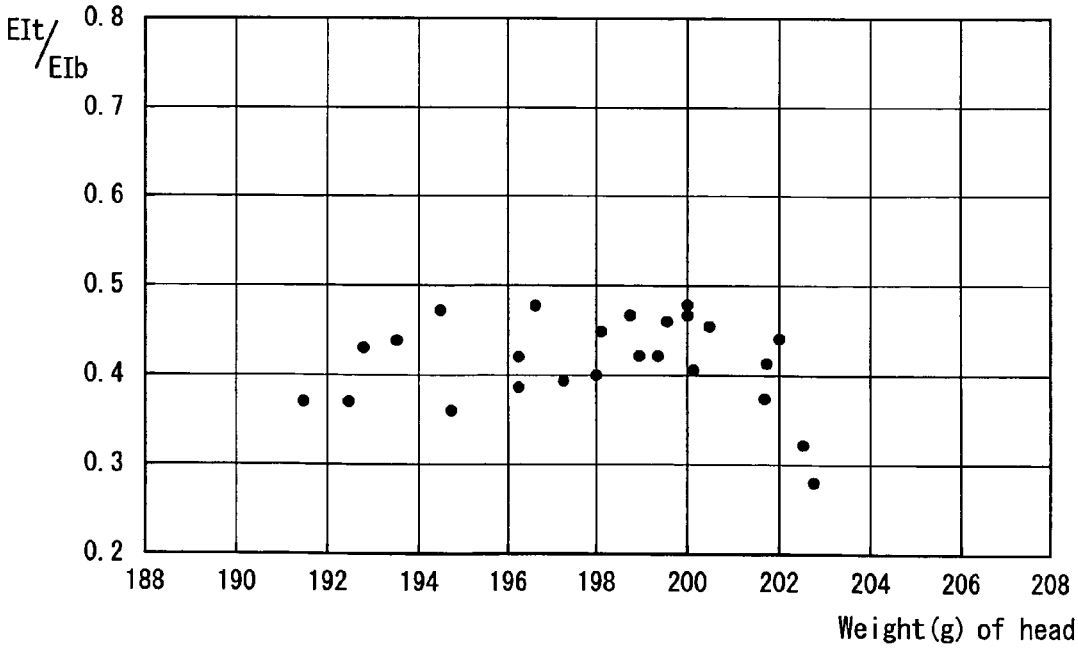
[Prior Art] Fig. 6
FIG. 6 is a distribution view showing setting of values of a ratio EIt/EIb with respect to weights of heads of golf clubs commercially available.

The rigidity values EIt and EIb were measured by using an all-purpose material testing machine of 2020 type (maximum load: 500 kg) of Intesco. In the measuring method, as shown in FIG. 4, each shaft 11 were supported at three points. The flexibility amount thereof was measured when a load of F was applied downward to points P1 and P2 at which the rigidity values EIt and EIb were measured respectively. More specifically, the point P1 at which the rigidity value EIt was measured was spaced by 130 mm from the head-side front end 12 of the shaft 11. The point P2 at which the rigidity value EIb was measured was spaced by 250 mm from the grip-side rear end 13 of the shaft 11. The span between both supporting points 31 was set to 200 mm. At both points P1 and P2, when the load F reached 20 kgf at a load-applying speed of 5 mm/second, the movement of a load-applying part was finished. At that time, the flexibility amount of the shaft 11 was measured. The rigidity values EIt and EIb were computed by using an equation shown below.

Computation of Rigidity Value $$EI(kg\cdot mm^2)=(\text{maximum load } F\times \text{distance}^3 \text{ between supporting points})\div(48\times\text{flexibility amount})$$

Example 1

The golf club of the example 1 had the same construction as that of the golf club of the first embodiment. More specifically, the weight of the head was 198 g. The ratio EIt/EIb was set to 0.60. The rigidity value EIt was set to $3.0\times10^6$ kgf·mm$^2$.

Example 2

The weight of the head was set to 192 g. The value of the ratio EIt/EIb was set to 0.52. The rigidity value EIt was set to $2.5\times10^6$ kgf·mm$^2$.

Example 3

The weight of the head was set to 202 g. The value of the ratio EIt/EIb was set to 0.55. The rigidity value EIt was set to $2.5\times10^6$ kgf·mm$^2$.

Example 4

The weight of the head was set equally to that of the head of the example 1. The rigidity value of the shaft at its head side was set large. That is, the weight of the head was set to 198 g. The value of the ratio EIt/EIb was set to 0.80. The rigidity value EIt was set to $4.0\times10^6$ kgf·mm$^2$.

Example 5

The value of the ratio EIt/EIb was equal to that of the example 1. The rigidity value EIt was also equal to that of the example 1. But the weight of the head was set large. That is, the weight of the head was set to 205 g. The value of the ratio EIt/EIb was set to 0.60. The rigidity value EIt was set to $3.0\times10^6$ kgf·mm$^2$.

Example 6

The value of the ratio EIt/EIb was equal to that of the example 1. The rigidity value EIt was also equal to that of the example 1. But the weight of the head was set larger than that of the head of the example 1. That is, the weight of the head was set to 208 g. The ratio EIt/EIb was set to 0.60. The rigidity value EIt was set to $3.0\times10^6$ kgf·mm$^2$.

Example 7

The weight of the head was equal to that of the example 1. The value of the ratio EIt/EIb was also equal to that of the example 1. But the rigidity value EIt was set smaller than that of the example 1. That is, the weight of the head was set to 198 g. The value of the ratio EIt/EIb was set to 0.60. The rigidity value EIt was set to $1.5\times10^6$ kgf·mm$^2$.

Example 8

The weight of the head was equal to that of the example 1. The value of the ratio EIt/EIb was also equal to that of the example 1. But the rigidity value EIt was set larger than that of the example 1. That is, the weight of the head was set to 198 g. The value of the ratio EIt/EIb was set to 0.60. The rigidity value EIt was set to $5.0\times10^6$ kgf·mm$^2$.

Comparison Example 1

The weight of the head was set to 198 g. The value of the ratio EIt/EIb was set to 0.40. The rigidity value EIt was set to $2.5\times10^6$ kgf·mm$^2$.

Comparison Example 2

The weight of the head was set to 192 g. The value of the ratio EIt/EIb was set to 0.48. The rigidity value EIt was set to $2.5\times10^6$ kgf·mm$^2$.

Comparison Example 3

The weight of the head was set to 202 g. The value of the ratio EIt/EIb was set to 0.48. The rigidity value EIt was set to $2.5\times10^6$ kgf·mm$^2$.

Ball-Hitting Test 10 testers of High Degree Class Player 8 to 25 were requested to hit 10 balls with each of the golf clubs of the examples and the comparison examples and make organoleptic evaluations on the degree of ease in the swing of each golf club on the basis of five marks (golf club having higher marks can be swung more easily than golf club having lower marks). The marks shown in table 1 are average values of the marks given by the 10 testers.

Evaluation of Directional Stability

The 10 testers 10 hit balls toward a target with each golf club. Variations (yard) in the left-to-right direction were totaled for each tester. Table 1 shows the average of variations of the 10 testers.

Measurement of Flight Distance

The 10 testers 10 hit balls with each golf club. Table 1 shows the average of flight distances (yard) of all hit balls.

As indicated in table 1 and FIG. 3, in the golf club of each of the examples 1 through 8, the value of the ratio EIt/EIb was not less than 0.50 nor more than 0.80. Therefore when a large head having a weight not less than 190 g was mounted on the shaft of the golf club of each example, hit balls had small variations in the left-to-right direction, i.e., were preferable in the directional stability and in addition secured sufficient flight distances. In addition, the golf clubs were highly evaluated in the degree of ease in the swing thereof. On the other hand, although the head of the golf club of each of the comparison examples 1 through 3 had a weight not less than 190 g respectively, the value of the ratio EIt/EIb of each of the golf clubs was less than 0.50. The balls hit with the golf clubs of the comparison examples 1 through 3 had larger variations in the left-to-right direction than the balls hit with the golf clubs of the examples. That is, the golf clubs of the comparison examples were less favorable than those of the examples in the directional stability. In addition the golf clubs of the comparison examples were evaluated low in the degree of ease in the swing thereof. The head-side front end of the shaft of each of the golf clubs of the comparison examples was flexible and thus had a large amount of deformation. Thereby the flight distances of the hit balls were considerably long, but the balls hit with the golf clubs of the comparison examples had large variations in the left-to-right direction. In addition, the testers were liable to feel that the head was heavy because the weight thereof was amplified by a large elastic deformation of the shaft at its front side.

What is claimed is:

1. A wood golf club which is not less than 44 inches in a length thereof and whose head is not less than 190 g in a weight thereof, wherein a value of a ratio of a rigidity value EIt at a position spaced at an interval of 130 mm from a head-side front end of a shaft of said golf club to a rigidity value EIb at a position spaced at an interval of 250 mm from a grip-side rear end of said shaft is set to not less than 0.60 nor more than 0.80; and said rigidity value EIt is not less than $2.50\times10^6$ kgf·mm$^2$ nor more than $4.00\times10^6$ kgf·mm$^2$.

2. The golf club according to claim 1, wherein said rigidity value EIb is not less than $2.00\times10^6$ kgf·mm$^2$ nor more than $10.00\times10^6$ kgf·mm$^2$.

3. The golf club according to claim 2, wherein a weight of said head is not more than 210 g.

4. The golf club according to claim 2, wherein a length of said golf club is set to not more than 48 inches; and a volume of a head is set to not less than 360 cc nor more than 500 cc.

5. The golf club according to claim 2, wherein a shaft is made of resin reinforced with a reinforcing fiber.

6. The golf club according to claim 1, wherein a weight of said head is not more than 210 g.

7. The golf club according to claim 6, wherein a length of said golf club is set to not more than 48 inches; and a volume of a head is set to not less than 360 cc nor more than 500 cc.

8. The golf club according to claim 6, wherein a shaft is made of resin reinforced with a reinforcing fiber.

9. The golf club according to claim 1, wherein a length of said golf club is set to not more than 48 inches; and a volume of a head is set to not less than 360 cc nor more than 500 cc.

10. The golf club according to claim 9, wherein a shaft is made of resin reinforced with a reinforcing fiber.

11. The golf club according to claim 1, wherein a shaft is made of resin reinforced with a reinforcing fiber.

12. The golf club according to claim 1, wherein the shaft comprises prepregs with reinforcing fibers oriented at an angle of 0° with respect to the axis of the shaft, the reinforcing fibers consisting of carbon fibers.

* * * * *